US006382150B1

(12) United States Patent
Fischer

(10) Patent No.: US 6,382,150 B1
(45) Date of Patent: May 7, 2002

(54) DESMODROMIC OSCILLATING CAM ACTUATOR WITH HYDRAULIC LASH ADJUSTER

(75) Inventor: Thomas Huntington Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/784,295

(22) Filed: Feb. 14, 2001

(51) Int. Cl.[7] ..... F01L 13/00

(52) U.S. Cl. ..... 123/90.16; 123/90.17; 123/90.24; 123/90.46

(58) Field of Search ..... 123/90.15, 90.16, 123/90.17, 90.22, 90.24, 90.25, 90.26, 90.4, 90.45, 90.46, 90.55, 90.6

(56) References Cited

U.S. PATENT DOCUMENTS 4,944,256 A * 7/1990 Matayoshi et al. ..... 123/90.24
5,937,809 A 8/1999 Pierik et al. ..... 123/90.16
6,041,746 A * 3/2000 Takemura et al. ..... 123/90.16
6,311,659 B1 * 11/2001 Pierik ..... 123/90.24

* cited by examiner

*Primary Examiner*—Wellun Lo
(74) *Attorney, Agent, or Firm*—John VanOphem

(57) ABSTRACT

A valve actuating mechanism includes opening and closing rotary cams rotatable together about a primary axis and a rocker pivotable about a first pivot axis spaced from the primary axis. The rocker includes first and second rocker arms connected to actuate a valve by oscillating motion about the pivot axis. The first and second rocker arms respectively carry opening and closing cam followers operable by the opening and closing cams for positively oscillating the rocker in either direction. The closing cam follower has a pad engagable with the closing cam and carried by a hydraulic lash control piston slidable in a cylinder of the second rocker arm. The cylinder is connected with a pressure oil supply having a check valve preventing reverse oil flow. A bleed orifice in the pad is sized to allow restricted oil flow from the cylinder to avoid excessive loading of the mechanism. The orifice may be blocked by the cam to limit oil flow during operation of the pad on the cam base circle. The piston is advanced by the oil pressure during cam base circle operation to take up lash between the cams and cam followers.

7 Claims, 4 Drawing Sheets

DESMODROMIC OSCILLATING CAM ACTUATOR WITH HYDRAULIC LASH ADJUSTER

TECHNICAL FIELD

This invention relates to valve actuating mechanisms and, more particularly, to desmodromic mechanisms wherein the actuator is moved positively in both opening and closing directions by mechanical action of the mechanism.

BACKGROUND OF THE INVENTION

U.S. Pat. No. 5,937,809, issued Aug. 17, 1999, discloses cam driven variable valve timing (VVT) mechanisms which are relatively compact, and are applicable for operating individual or multiple valves. In these mechanisms, an engine valve is driven by an oscillating rocker cam that is actuated by a linkage driven by a rotary eccentric, preferably a cam. The linkage is pivoted on a control member that is, in turn, pivotable about the axis of the rotary cam and angularly adjustable to vary the orientation of the rocker cam and thereby vary the valve lift and timing. The rotary cam may be carried on a camshaft. The oscillating cam is pivoted on the rotational axis of the rotary cam.

The engine valve driven by the cam is conventionally provided with a return valve spring that closes the valve as the oscillating cam is returned to a valve closed position. The linkage driven by the rotary cam is not directly acted upon by the valve spring and so is provided with one or more return springs for returning the linkage to the valve closed position as the rotary cam is rotated, so that the cam follower returns to the cam base circle (the valve closed position). Further development of these mechanisms has included design of improved return springs for biasing the actuating linkage toward the valve closed position. Additionally, desmodromic cam driven mechanisms have been developed for positively driving the oscillating cam and linkage in both the opening and closing directions. Such mechanisms include both opening and closing cams driving the linkage and thus eliminate the biasing springs for the linkage, but not for the valve.

A desmodromic mechanism allows the oscillating cam and linkage to be operated at higher engine speeds without floating, that is, without losing contact of the follower with the opening cam. However, some amount of lash must be provided in the desmodromic mechanism to avoid overstressing the components by interference of the mechanism's opening and closing portions. Because excessive lash can cause noise and stresses due to accelerations of the moving components, suitable means for taking up the lash in the oscillating cam drive mechanism have been considered.

SUMMARY OF THE INVENTION

The present invention provides a valve actuating mechanism intended for use with a desmodromic cam driven variable valve timing mechanism but applicable also to other desmodromic cam and rocker devices.

In an exemplary embodiment, the mechanism includes opening and closing rotary cams rotatable together about a primary axis and a rocker pivotable about a first pivot axis spaced from the primary axis. The rocker is connectable to actuate a valve by oscillating motion about the pivot axis and has first and second rocker arms respectively carrying opening and closing cam followers spaced from the pivot axis. The cam followers operatively engage the opening and closing rotary cams respectively and are operable by the cams for positively oscillating the rocker in either direction about the first pivot axis;

The closing cam follower has a pad engagable with the closing cam and carried by a hydraulic lash control piston slidable in a bore of the second rocker arm. The bore is connected with a pressure oil supply including a check valve preventing reverse flow of oil toward the oil supply. A bleed orifice in the pad is sized to allow restricted outflow of oil from the bore to avoid excessive loading of the opening and closing portions of the mechanism, the piston being advanced by the oil pressure to take up lash occurring between the cams and cam followers.

The rocker as described above could be connected to directly actuate a valve in opening and closing directions and the lash adjusting means would operate to take up lash in the manner indicated. However, the rocker may also be connected as part of an oscillating cam variable valve timing (VVT) mechanism including, for example, an output lever connected to the first rocker arm and carrying an oscillating output cam engaging a valve actuating member, and a control member pivotable about the primary axis and carrying the rocker on the first pivot axis. Moving the control member angularly varies engagement of the oscillating cam with the valve actuating member between full lift and no lift valve opening positions, thus providing variable lift and timing of the valve.

These and other features and advantages of the invention will be more fully understood from the following description of certain specific embodiments of the invention taken together with the accompanying drawings.

DESCRIPTION OF THE PREFERRED EMBODIMENT

Figure 1:
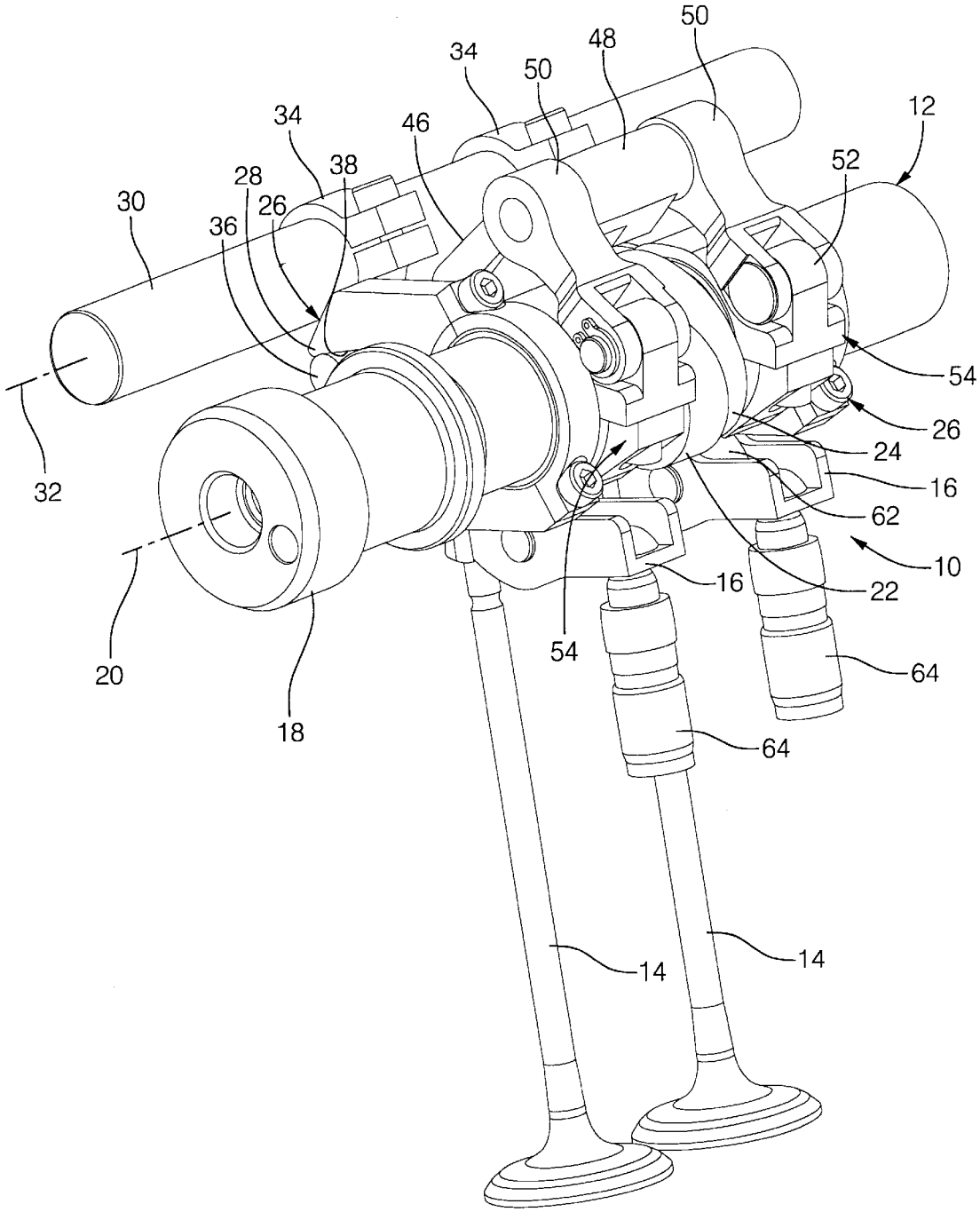
FIG. 1 is a pictorial view of a VVT mechanism according to an exemplary embodiment of the invention.

Referring now to the drawings in detail, numeral 10 generally indicates a portion of an internal combustion engine including an exemplary embodiment of valve actuating variable valve timing (VVT) mechanism 12 which is operable to actuate dual inlet valves and vary valve timing and lift for a single cylinder of the engine. Mechanism 12 includes a camshaft 18 rotatable on a primary axis 20 and carrying axially adjacent opening and closing rotary cams 22, 24. The camshaft may extend the length of a cylinder head, not shown, of a multi-cylinder engine, of which the mechanism for only a single cylinder is illustrated.

Mechanism 12 further includes a pair of control members (or frames) 26 in the form of carrier levers that are mounted on the camshaft and pivotable about the primary axis 20. The control members each include an outer end 28 that is connected by suitable means with a control shaft 30. The control shaft is pivotable about a secondary axis 32 spaced from and parallel with the primary axis 20. Control arms 34 mounted on the control shaft carry pins 36 that engage slots 38 in the outer ends 28 of the control members 26 to oscillate the control members about the primary axis 20 and vary the valve lift and timing as will be subsequently described.

Figure 2:
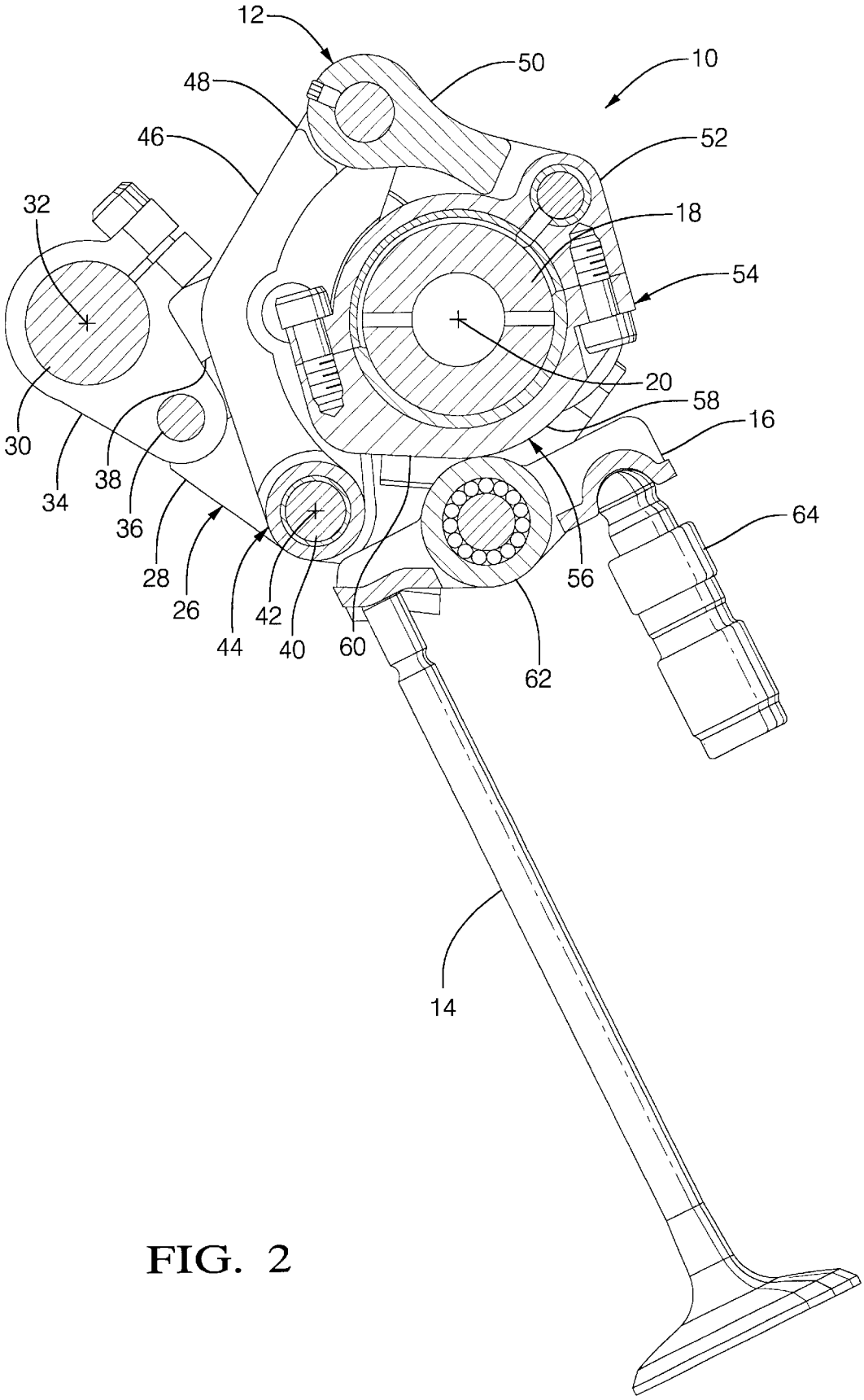
FIG. 2 is a cross-sectional view through the output lever and valve actuator.

As is shown in FIG. 2, the outer ends 28 of the control members also carry a pivot pin 40 disposed on a first pivot axis 42. A rocker 44 is pivotally mounted on the pivot pin 40, which connects the rocker with the control members 26. A first rocker arm 46 of the rocker 44 extends from a first end at the pivot pin 40 to a distal end 48 pivotally connected to a pair of links 50. The links 50 extend from the rocker arm 46 to outer ends 52 of a pair of actuating levers 54 to which the links 50 are pinned. The actuating levers 54 are mounted on the camshaft 18 and pivotable about the primary axis 20. The levers 54 define oscillating cams 56, each having a base circle portion 58 and a valve lift portion 60.

The oscillating cams 56 are engaged by rollers 62 of roller finger followers 16, each having inner ends that are pivotally seated on stationary hydraulic lash adjusters 64 mounted in the engine cylinder head, not shown. Outer ends of the finger followers 16 engage the stems of valves 14 for directly actuating the valves in cyclic variable lift opening and closing patterns as controlled by the mechanism. Valve springs, not shown, are conventionally provided for biasing the valves in a closing direction.

Figure 3:
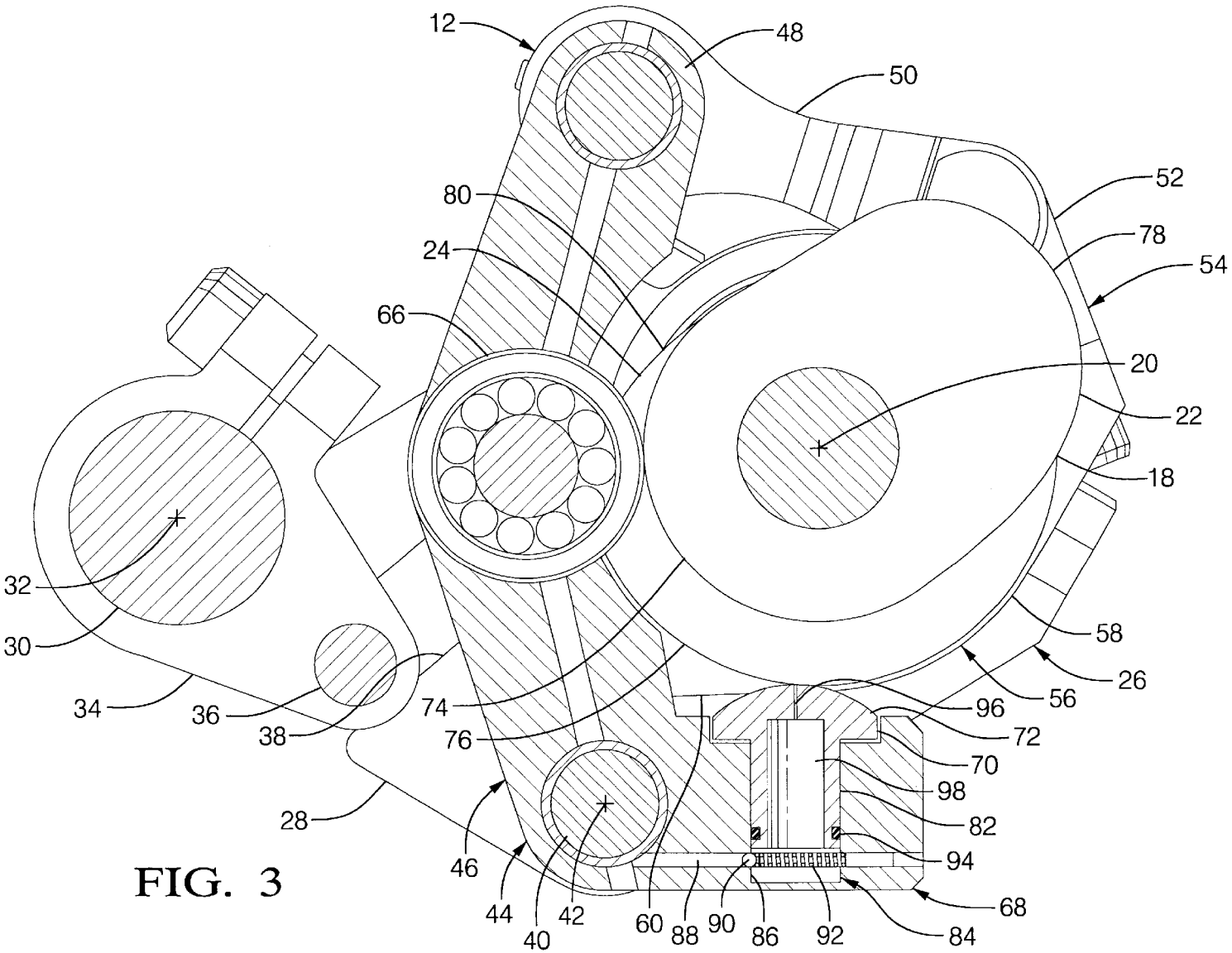
FIG. 3 is a cross-sectional view showing the valve opening cam and rocker interface.
Figures 4, 5:
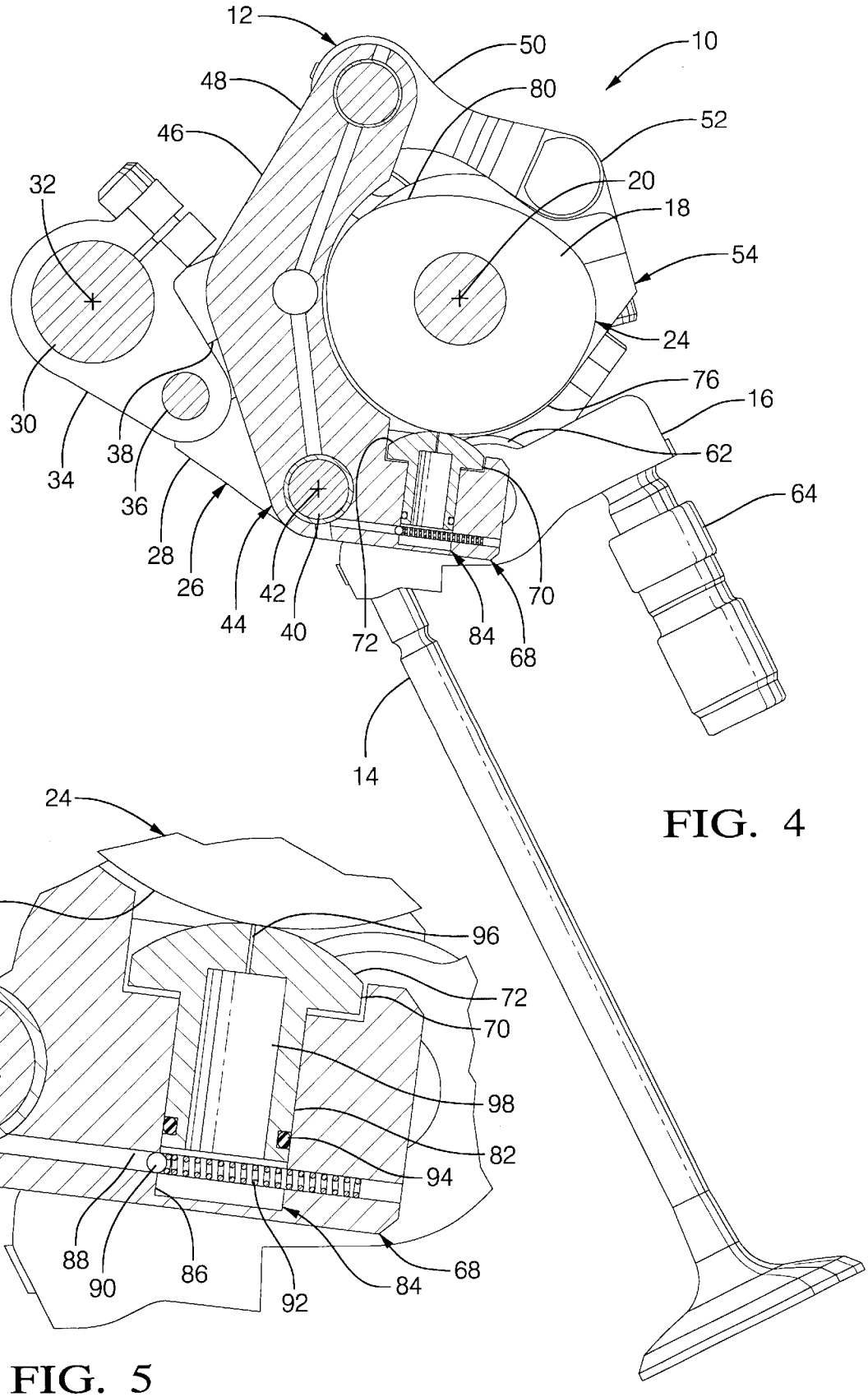
FIG. 4 is a cross-sectional view showing the valve closing cam and interface.
FIG. 5 is an enlarged cross-sectional view showing the lash take-up mechanism.

Between its ends, rocker arm 46 carries a follower roller 66, shown in FIG. 3, which engages the rotary opening cam 22. FIGS. 3 and 4 both illustrate the provision on rocker 44 of a second rocker arm 68, extending from the pivot pin 40 at an angle to the first rocker arm 46. The second rocker arm 68 carries a follower pad 70 having a curved contact surface 72 engaging the closing cam 24 of the mechanism 12. Flat or compound contact surfaces could be substituted if desired. In the valve closed position of the mechanism shown in the figures, the follower roller 66 and the follower pad 70 are engaging base circle portions 74, 76 of the opening cam 22 and closing cam 24, respectively. As valve actuating portions 78, 80 of cams 22 and 24, respectively, simultaneously engage the roller 66 and pad 70, the valves 14 may be opened and closed depending on the setting of the control members 26 of the mechanism 12.

Pad 70 is connected with a hollow hydraulic lash control piston 82 of a hydraulic lash adjusting (HLA) mechanism 84, shown enlarged in FIG. 5. Mechanism 84 further includes a close clearance cylinder 86, which receives the piston 82 in the second rocker arm 68. An oil feed passage 88 intersects the cylinder 86 at an opening controlled by a check valve 90 that is biased closed by a spring 92.

A seal ring 94 on the piston 82 limits oil leakage between the piston 82 and the cylinder 86. Instead, a restrictive orifice 96 extends through the pad 70 from the hollow interior of the piston 82 to the curved contact surface 72. The orifice allows controlled leakdown of oil from within a pressurized chamber 98 formed by the cylinder 86 and the hollow piston interior. Preferably, the orifice 96 is located to open through a point of contact of the surface 72 with the closing cam 24 when the pad 70 is engaging the base circle portion 76 of the closing cam 24. The orifice is then at least partially blocked by the cam surface 76 so that oil leakdown through the orifice is further restricted until the valve actuating portion 80 of cam 24 engages the follower pad 70

Operation of the VVT mechanism 12 in engine 10 is as follows:

When the control arms 34 are rotated to their furthest counterclockwise positions as shown in the figures, the mechanism 12 is set for full opening of the valves 14. As the camshaft 18 rotates the cams 22, 24 so that their valve actuating portions 78, 80 engage the follower roller 66 and pad 70, respectively, the rocker 44 is first pivoted counterclockwise, drawing the links 50 leftward and rotating the actuating levers 54 counterclockwise. The valve lift portions 60 of the oscillating cams 56 then drive the finger followers 16 downward, opening the valves 14. As rotation continues and the followers 66, 70 are returned to the base circle portions 74, 76 of the cams 22, 24, respectively, the rocker 44 is pivoted clockwise and the actuating levers 54 are again rotated clockwise, returning the oscillating cams 56 and the finger followers 16 to their valve closed positions where the finger follower rollers 62 are in contact with the base circle portions 58 of the oscillating cams 56.

As the control shaft 30 and control arms 34 are rotated toward their furthest clockwise positions, the non-lift positions not shown, the control members 26, links 50 and rocker 44 are together rotated counterclockwise until the finger follower rollers engage the base circle portions 58 of the oscillating cams at the farthest points from their valve lift portions 60. Then, when the valve actuating portions 78, 80 of the rotary cams 22, 24 engage their followers 66, 70, primarily only the base circle portions 58 of the oscillating cams 56 engage the follower pad 70. Thus the valves 14 are not opened or are opened only slightly. At intermediate positions of the control shaft 30 and control members 26, the valve opening is proportionally advanced and the valve lift is increased.

It should be apparent that the valves 14 are opened by the valve actuating portion 78 of the opening cam acting against follower roller 66 to pivot the first rocker arm 46 counterwise and, through links 50, oscillate cams 56 to open the valves (except in the non-lift positions of the control members 26). Closing of the valves is accomplished by the valve actuating portion 80 of the closing cam 24, which engages the follower pad 70 and positively forces the second rocker arm to pivot clockwise, moving the rocker 44 back to its original position with the followers 66, 70 on their respective base circles of the cams 22, 24. This action returns the oscillating cams to their original valve closed positions and allows the valve springs, not shown, to close the valves in conventional fashion.

Since the rotary cams 22, 24 positively actuate the rocker 44 in both directions, it is necessary to provide some lash in the rocker actuating mechanism. However, to avoid the noise, shock loading and wear which may result from excessive lash, the present invention provides a hydraulic lash adjusting (HLA) mechanism 84 to take up the lash and provide smooth operation of the oscillating rocker drive system. Pressurized oil fed from a lubricant supply to the pivot pin 40 is directed through the feed passage 88 to the pressurized chamber 98 in the cylinder 86. The oil pressure forces the hollow piston 82 outward to hold the contact surface 72 of follower pad 70 in engagement with the closing cam 24.

The restrictive orifice 96 through the pad 70 allows a restricted flow of oil to be forced out of the chamber 98 to create some lash when the pad is placed under load by the closing cam 24. However, while the pad 70 is in contact with the base circle 76 of cam 24, the orifice 96 is blocked by engagement of the cam with the pad contact point where the orifice opens through the curved contact surface 72 of the pad. Thus oil flow from the chamber is minimized, avoiding unneeded oil flow, and the pressure in the chamber 98 is maintained by the oil feed from passage 88 and by the check valve 90, which prevents a return flow of the oil. When the valve actuating portion 80 of cam 24 reaches the pad 70, the orifice is unblocked and oil flow is allowed to lubricate the cam surface while the discharged oil is replaced by oil from the feed passage 88 and the rocker 44 is moved by the opening cam 22 to the valve open position.

As the closing cam 24 rotates further to return the rocker 44 to the valve closed position, the closing cam forces the piston 82 downward, increasing the pressure in chamber 98. This holds the check valve 90 closed and discharges some oil out of the chamber 98 through the orifice 96, thereby providing a restricted leakdown that introduces some lash into the system and avoids excessive loading of the mechanism. When the rocker 44 has returned to its original position and the pad 70 is again riding on the base circle 80 of the closing cam 24, the pressure in chamber 98 falls. Oil from the feed line then expands the chamber and takes up the lash by forcing the piston 82 up so that the pad 70 again rides on the base circle 80 of the closing cam 24.

The present invention thus provides a novel lash take up hydraulic lash adjusting (HLA) mechanism in a desmodromic oscillating rocker valve actuating mechanism wherein a pivoting rocker is positively actuated by the mechanism in both opening and closing directions. The HLA mechanism is particularly suitable for use in a variable valve timing mechanism having oscillating valve actuating cams driven by the pivoting rocker, all as described and shown in the illustrated VVT mechanism 12. However, application of the HLA mechanism in other pivoting rocker actuated devices is also contemplated.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. Valve actuating mechanism comprising:

opening and closing rotary cams rotatable together about a primary axis; and a rocker pivotable about a first pivot axis spaced from the primary axis, the rocker being connectable to actuate a valve by oscillating motion about the pivot axis and having first and second rocker arms respectively carrying opening and closing cam followers spaced from the pivot axis, the cam followers operatively engaging the opening and closing rotary cams respectively and operable by the cams for positively oscillating the rocker in either direction about the first pivot axis;

said closing cam follower having a pad engagable with the closing cam and carried by a hydraulic lash control piston slidable in a cylinder of the second rocker arm, the cylinder connected with a pressure oil supply including a check valve preventing reverse flow of oil toward the oil supply, and a bleed orifice in the pad and sized to allow restricted outflow of oil from the cylinder to avoid excessive loading of opening and closing portions of the mechanism, the piston being advanced by the oil pressure to take up lash occurring between the cams and cam followers.

2. Valve actuating mechanism as in claim 1 wherein the pad has a contact surface engaging the closing cam and the bleed orifice opens through the contact surface at a control point that is engaged by an arcuate base circle portion of the closing cam when the contact surface is engaging the base circle portion, such engagement at least partially blocking the orifice and thereby further restricting oil flow through the orifice and assisting lash take up, the closing cam also including nonarcuate actuating portions that engage the pad contact surface at points spaced from the control point, which reduces blocking of the bleed orifice and allows controlled retraction of the hydraulic piston to avoid excessive loading by temporarily increasing lash during actuating motion of the mechanism.

3. Valve actuating mechanism as in claim 2 wherein the contact surface of the pad is a curved surface for engaging the closing cam.

4. Valve actuating mechanism as in claim 1 and including an actuating output lever pivotable about the primary axis and carrying an oscillating output cam engaging a valve actuating member, the output cam having a base circle portion and a valve lift portion, the output lever being connected with the first rocker arm for oscillating the output cam to actuate the valve.

5. Valve actuating mechanism as in claim 4 and including a control member pivotable about the primary axis and carrying the rocker on the first pivot axis, the control member being movable between a first angular position wherein primarily the valve lift portion of the output cam engages the valve actuating member for fully opening and closing the valve and a second angular position wherein primarily the base circle portion of the oscillating output cam engages the valve actuating member for providing minimal opening and closing movement of the valve.

6. Valve actuating mechanism as in claim 5 wherein the valve actuating member contacts a lash adjuster that controls lash between the actuating member and the valve.

7. Valve actuating mechanism as in claim 1 and including a seal between the lash control piston and the cylinder to limit leakage of oil from the cylinder other than through the bleed orifice.

* * * * *